United States Patent [19]

Giannetti

[11] 4,147,346

[45] Apr. 3, 1979

[54] EASY GLIDE CUE GUIDE

[76] Inventor: Anthony Giannetti, 297 Germantown Rd. - R.D. #2, West Milford, N.J. 07480

[21] Appl. No.: 778,065

[22] Filed: Mar. 16, 1977

[51] Int. Cl.[2] ..... A63D 15/10

[52] U.S. Cl. ..... 273/23

[58] Field of Search ..... 273/23, 24, 14, 2, 68; 272/65.5 SS

[56] References Cited

U.S. PATENT DOCUMENTS

| | | | |
|---|---|---|---|
| 2,352,294 | 6/1944 | Stapff | 273/24 UX |
| 2,924,455 | 2/1960 | Brunel | 272/65.5 SS |
| 3,416,794 | 12/1968 | Ciano | 273/24 |
| 3,534,959 | 10/1970 | Elswick | 273/23 |

FOREIGN PATENT DOCUMENTS

| | | | |
|---|---|---|---|
| 523666 | 4/1921 | France | 273/23 |
| 1200121 | 12/1959 | France | 273/23 |

*Primary Examiner*—Richard C. Pinkham
*Assistant Examiner*—T. Brown
*Attorney, Agent, or Firm*—Clarence A. O'Brien; Harvey B. Jacobson

[57] ABSTRACT

A guide adapted to be hand held and adapted to receive the shaft of a cue stick when playing pool so that the cue stick may glide easily when used to hit the cue ball. The guide includes a longitudinally extending sleeve which is longitudinally split into two substantially identical sections having one longitudinal edge hingedly connected and the other longitudinal edge engaged by the forefinger when in use to retain the guide in proper association with the cue stick. The sleeve is internally tapered in a manner corresponding to the taper of the cue stick and is provided with longitudinal ribs and grooves to facilitate the sliding movement of the cue stick in relation to the guide. The guide also includes a depending support to provide a handle for the guide and to supportingly engage the pool table surface during certain use procedures to provide a steady support for the cue stick to enable it to be more accurately aimed and controlled when hitting the cue ball.

7 Claims, 4 Drawing Figures

EASY GLIDE CUE GUIDE

BACKGROUND OF THE INVENTION

1. Field of the Invention

The present invention generally relates to a guide for a cue stick which enables the cue stick to be more accurately aimed and controlled during use when hitting the cue ball with the guide including a split sleeve having a tapered, longitudinally ribbed interior construction providing easy gliding engagement with the cue stick.

2. Description of the Prior Art

Various devices have been provided to enable a cue stick to be guided when striking the cue ball. Such devices are frequently used when the cue ball is in a position on a table that requires the cue stick to be extended substantially completely across the table. Such devices, usually referred to as "bridges", only provide supporting engagement with the undersurface of the cue stick and do not provide any substantial guiding function. Other devices are known which are hand held and faclitate sliding movement of the cue stick in relation to facilitate hand of the user. Exemplary of the development in this field of endeavor are the following U.S. Pat. Nos.:

529,731 - Nov. 27, 1894
635,569 - Oct. 24, 1899
690,617 - Jan. 7, 1902
1,299,720 - Apr. 8, 1919
2,014,788 - Sept. 17, 1925
2,931,649 - Apr. 5, 1960.

SUMMARY OF THE INVENTION

An object of the present invention is to provide an easy glide cue stick guide incorporating a hand held, longitudinally elongated, tapered, internally ribbed, split sleeve in which the two halves of the sleeve are pivotally connected and retained in guiding but yet very light frictional engagement with the tapered shaft on the cue stick by exerting finger pressure thereon by the forefinger when the guide is being used thereby facilitating the longitudinal movement of the cue stick by enabling it to easily glide through the sleeve and also maintaining more accurate control of the aim and path of movement of the cue stick when the cue stick is used to strike the cue ball.

Another object of the invention is to provide a guide in accordance with the preceding object in which the ribs extend longitudinally and are constructed so that it is unnecessary to utilize powder on the exterior of the cue stick and friction reducing balls are employed internally of the sleeve to facilitate the ease of sliding movement of the cue stick in relation to the guide.

A further object of the invention is to provide a guide in accordance with the preceding objects having a laterally extending, adjustable length support member rigid with respect to the sleeve and perpendicular thereto for supporting engagement with the surface of the pool table to further control the aim and provide a steady support for the guide and cue stick guided thereby.

Still another object of the invention is to provide an easy glide cue stick guide in which the two halves of the longitudinally split sleeve have a spring structure associated with the hinge along one edge of the sleeve to spring bias the two halves of the sleeve together in a manner which will not induce sufficient friction against the cue stick to retard its longitudinal movement with the control of the longitudinal movement being obtained by the person using the device with his forefinger wrapped partially around the split sleeve at the peripheral portion of the sleeve in opposite relation to the hinge connection.

Still another important object of the present invention is to provide a guide in accordance with the preceding objects which is relatively simple in construction, easy to use, effective to glidingly support a pool cue stick and maintain an accurate aim and path of movement for the cue stick.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
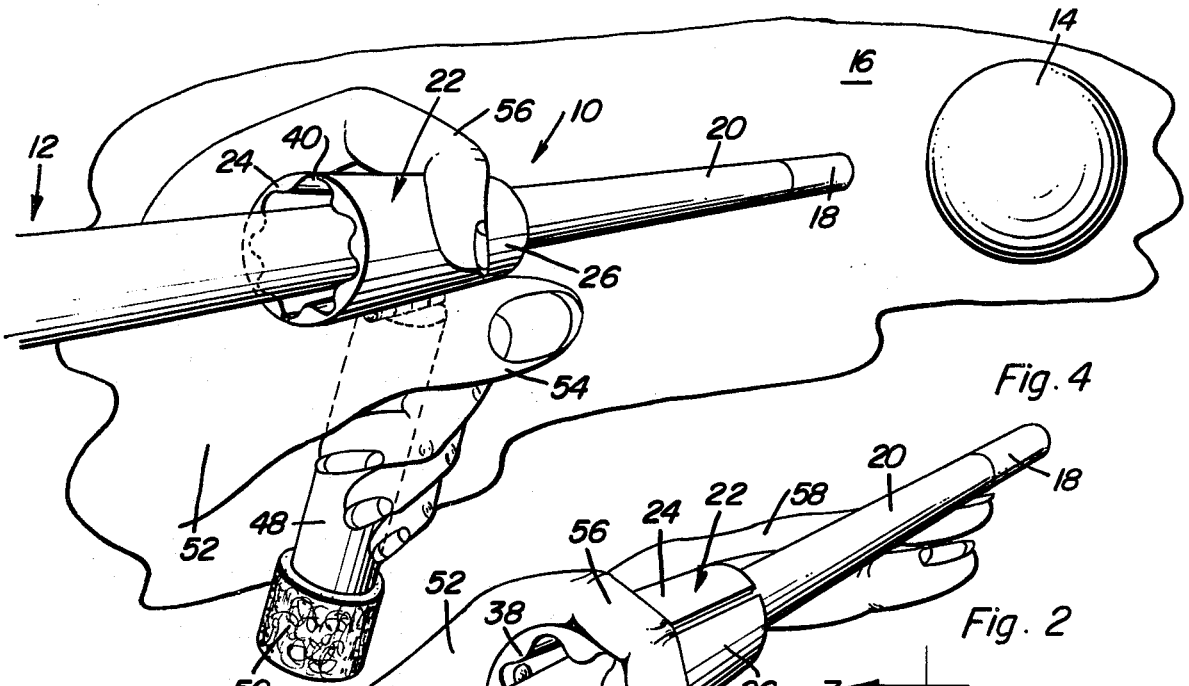
FIG. 1 is a perspective view of the easy glide cue guide illustrating schematically the manner of using the guide for aiming and controlling the path of movement of a cue stick when it is used to strike a cue ball.

The easy glide cue guide of the present invention is generally designated by numeral 10 and is illustrated in use in FIG. 1 for guiding the cue stick generally designated by numeral 12 toward a cue ball 14 for causing the cue ball 14 to move along a pool table surface 16 toward a target area, ball, or the like, in which it is necessary to properly position the cue stick 12 so that its tip 18 will be properly positioned with respect to the cue ball 14 and the tapered shaft 20 of the cue stick 12 will be properly aimed and controlled during its movement toward the cue ball 14 in a manner which is well known in playing pool or other similar games.

The guide 10 includes an elongated tapering sleeve 22 which is longitudinally split into two substantially identical substantially semi-frusto-conical members 24 and 26 which are hingedly interconnected along their lower edges by a hinge structure generally designated by numeral 28 and which includes a hinge pin 30 extending through aligned, interdigitated hinge barrels or pintles 32 and 34 which are integral with the respective members 24 and 26. An axial coil spring 36 is associated with the hinge pin in a manner to lightly spring bias the members 24 and 26 toward each other. The opposite edges of the members 24 and 26 are free and capable of movement toward and away from each other to facilitate movement of the tapered shaft of the cue stick 12 in relation to the sleeve 22.

The interior of the sleeve 22 is provided with a plurality of longitudinally extending ribs or ridges 38 interconnected by longitudinal grooves or valleys 40 with the apex of each of the ribs or ridges also tapering or being inclined at the same angle of taper as the tapered shaft 20 so that the plurality of circumferentially spaced ribs or ridges 38 will be in sliding and guiding contact with the tapered shaft 20 throughout the length of the ribs or ridges 38. The pivotal movement of the members 24 and 26 enables the tapered shaft 20 to slide through the sleeve 22 with the sleeve 22 opening or expanding in effective diameter as the tapered shaft moves toward the cue ball and closing or retracting in diameter as the tapered shaft 20 moves in the opposite direction.

Figure 2:
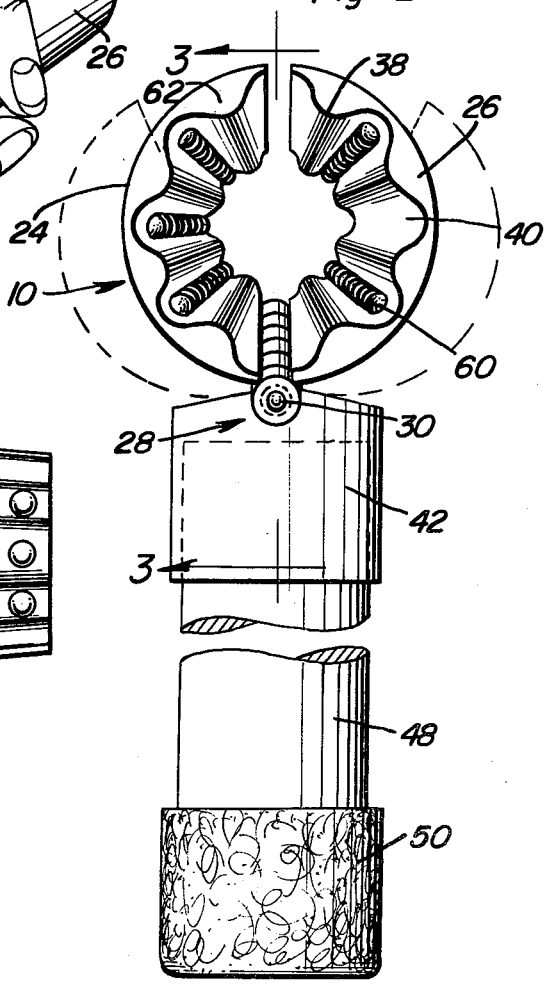
FIG. 2 is an end elevational view of the guide.
Figure 3:
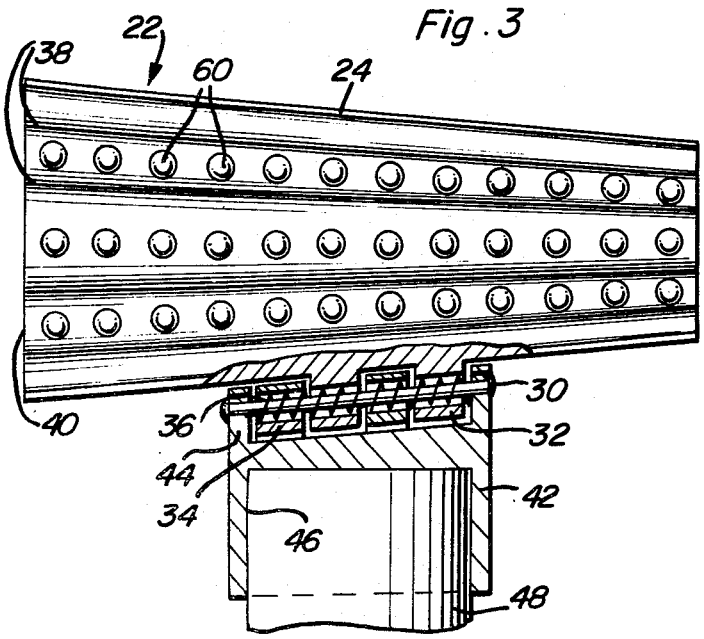
FIG. 3 is a longitudinal, sectional view taken generally upon a plane passing along section line 3—3 of FIG. 2 illustrating the structural details of the guide.

The sleeve 22 has a depending tubular holder or nipple 22 connected thereto by the hinge pin 30 which also extends through tabs 44 on the upper end of the holder 42 as illustrated in FIG. 3. The holder 42 is provided with a tubular socket 46 in its lower end for receiving a rather short tubular member 48 which may be in the form of a pipe nipple, tubular plastic member, or solid rod, which is telescoped into the socket 46 and detachably secured thereto as by friction, screw threaded connection, or by any other suitable means. The lower end of the support member 48 is provided with a cushioning cap 50 thereon which may be of plastic or resilient material and frictionally mounted on the cylindrical or tubular support member 48 as illustrated in FIG. 2. The cushioning cap 50 is adapted to rest on the pool table surface 16 as illustrated in FIG. 1 during use. The hand 52 of the person using the cue stick engages around the holder 42 and adjacent portion of the support member 48 as illustrated in FIG. 1 with the thumb 54 underlying the sleeve 22 and the forefinger 56 extending over top of the sleeve 22 so that by exerting pressure on the sleeve 22 by use of the forefinger 56, the person using the guide 10 may determine the frictional engagement between the cue stick shaft 20 and the guide sleeve 22, thereby enabling control of the movement of the cue stick 12 with the holder 42, support member 48 and cap 50 providing a steadying support for the stick in order to maintain proper control of the cue stick when aiming the cue stick in its optimum relationship to the cue ball 14 and when the cue stick is being moved in its path of movement when the cue ball is being struck by the tip 18 of the cue stick 12.

Figure 4:
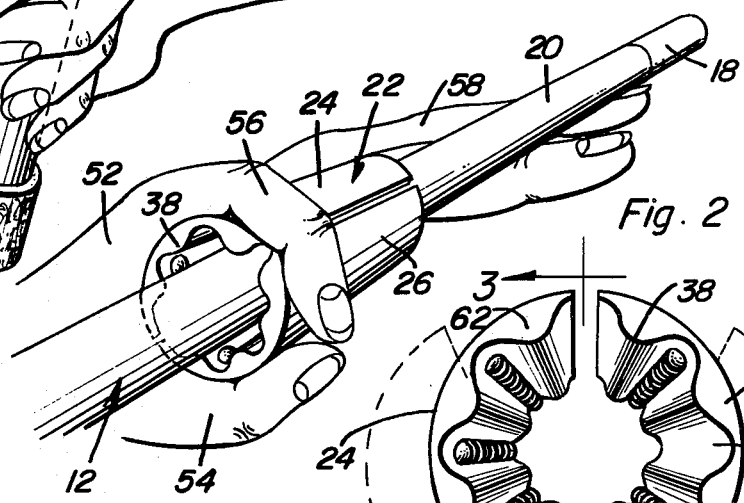
FIG. 4 is a perspective view of the device in use without the supporting pedestal.

In some instances, the guide 10 may be used without the support member 48 or the cap 50 in which event the hand 52 is placed around the sleeve 22 with the thumb 54 underlying the sleeve 22 and the forefinger 56 overlying the sleeve 22 as illustrated in FIG. 4. In this position, the remainder of the hand including the fingers 58 are spread out and rest against the pool table surface in a conventional and well known manner.

To reduce the frictional engagement between the guide sleeve and the cue stick, the grooves or valleys 40 may be provided with a plurality of spherical members in the form of ball bearings, or the like, 60 partially embedded therein in a manner that the peripheries of the ball bearings 60 will lie inwardly in the same circular plane as the apices of the ribs 38 for engagement with the cue stick without introducing any frictional resistance to movement and, in fact, reducing the frictional resistance to a minimum. The spherical members are embedded in the interior of the sleeves which may be formed integrally or as an insert of hard rubber, plastic, or similar material, as designated by numeral 62 with the material encapsulating slightly more than one half of the periphery of the spherical balls.

The internal taper of the guide sleeve 22 corresponds with the taper on the tapering shaft of the cue stick and guidingly engages the cue stick at circumferentially spaced lines of contact, thus providing an accurate control of the cue stick during its movement so that the cue stick will glide easily when hitting the cue ball with a sort of interferring dry rub similar to that imparted to the cue stick when a person is guiding the cue stick by using his fingers and thumb in a conventional manner. This device does not require the use of powder, such as is normally employed on the fingers, to prevent the cue stick from sticking to the fingers and provides adequate control to the cue stick such that persons normally unable to hold the cue stick steady will be able to accurately aim and control the cue stick, thus enabling such players to obtain more enjoyment from playing pool.

The device may be constructed of plastic material, metal, or any other suitable equivalent materials, thus rendering the device relatively inexpensive to manufacture and easily used by various pool players regardless of the size of cue stick which is used within the limits of the swinging movement of the sleeve members 24 and 26.

The foregoing is considered as illustrative only of the principles of the invention. Further, since numerous modifications and changes will readily occur to those skilled in the art, it is not desired to limit the invention to the exact construction and operation shown and described, and accordinngly all suitable modifications and equivalents may be resorted to, falling within the scope of the invention.

What is claimed as new is as follows:

1. A hand held guide for a cue stick when used to strike a cue ball comprising an elongated hollow sleeve, said sleeve being constructed of a pair of substantially identical members; hinge means pivotally connecting said members together along one longitudinal edge thereof to enable the two members to pivot in relation to each other to receive a tapered cue stick therebetween and to engage a cue stick along a substantial portion of its length at circumferentially spaced points to accurately guide a cue stick during relative longitudinal movement through the sleeve, said sleeve having internal, longitudinally extending ribs for engaging a cue stick and being longitudinally tapered with the effective circumference thereof increasing and decreasing as the tapered shaft of a conventional cue stick is moved longitudinally therethrough, the exterior of the sleeve being adapted to be engaged by the thumb and forefinger of a person using the guide to maintain supporting contact of the guide with a cue stick by forefinger pressure being exerted on the members forming the sleeve.

2. The structure as defined in claim 1, wherein said sleeve includes a laterally extending support member adapted to rest upon a pool table surface in order to steady the sleeve and cue stick received therein, said support member including a downwardly opening socket and a detachable member having a cushioning cap on the lower end received in the socket with the cushioning cap adapted to engage the pool table surface.

3. The structure as defined in claim 2, wherein said sleeve includes longitudinally extending rows of ball bearings oriented in circumferentially spaced relation for engagement with a cue stick.

4. The structure as defined in claim 2, together with spring means lightly biasing the pivotal members toward closed position.

5. The structure as defined in claim 2, wherein said sleeve further includes internal, longitudinally extending rows of ball bearings oriented in circumferentially spaced relation, and said pivotal members being interconnected by resilient means biasing said members toward each other.

6. In combination, an elongated, longitudinally tapered pool cue stick adapted to be moved longitudinally when striking a cue ball, a hand held guide for the cue stick, said guide comprising an elongated, hollow, tapered sleeve with the internal taper of the sleeve corresponding generally to the external taper of a conventional pool cue stick, said sleeve being constructed of a pair of substantially identical semi-frusto-conical members, hinge means pivotally connecting said members together along one longitudinal edge thereof with the other longitudinal edges adapted to be swung toward and away from each other to receive a tapered cue stick therebetween and to enable the sleeve to be snugly engaged with a cue stick by a player engaging the exterior of the sleeve with the thumb and forefinger of the hand holding the guide in stationary position in relation to a pool table, the interior of said sleeve including a plurality of inwardly projecting longitudinal ribs spaced circumferentially from each other to engage a cue stick at circumferentially spaced areas to facilitate relative longitudinal movement between a cue stick and guide when a cue stick is moved longitudinally to engage a cue ball.

7. The combination as defined in claim 6, wherein said sleeve is provided with ball bearing members mounted on the interior thereof for reducing the friction between the sleeve and a cue stick during longitudinal movement of a cue stick through the sleeve when striking a cue ball, resilient means interconnecting said members defining the sleeve for biasing the members into engagement with a cue stick and a laterally extending stabilizing support member connected with the sleeve to enable the sleeve to be more stably supported in relation to a pool table.

* * * * *